US006431978B1

(12) United States Patent
Israel

(10) Patent No.: US 6,431,978 B1
(45) Date of Patent: Aug. 13, 2002

(54) SLOT OUTLET ARRANGEMENT FOR AIR SCREEN INSTALLATIONS

(76) Inventor: Christian Israel, Drosselweg 5, D-09128 Chemnitz (DE)

( * ) Notice: Subject to any disclaimer, the term of this patent is extended or adjusted under 35 U.S.C. 154(b) by 0 days.

(21) Appl. No.: 09/825,180

(22) Filed: Apr. 3, 2001

(30) Foreign Application Priority Data

Apr. 5, 2000 (DE) ..... 100 17 019

(51) Int. Cl.[7] ..... F24F 9/00

(52) U.S. Cl. ..... 454/188; 454/191; 454/301; 454/305

(58) Field of Search ..... 454/188, 189, 454/191, 192, 193, 284, 287, 288, 292, 299, 301, 303, 304, 305

(56) References Cited

U.S. PATENT DOCUMENTS 3,773,000 A * 11/1973 Applegate

FOREIGN PATENT DOCUMENTS

| | | | | |
|---|---|---|---|---|
| DE | 30 00 554 | * | 7/1981 | ..... 454/305 |
| DE | 89 14 343.4 | | 5/1991 | |
| DE | 94 07 112.8 | | 10/1994 | |
| EP | 0 362 958 | | 4/1990 | |
| SU | 909465 | * | 2/1982 | ..... 454/305 |

* cited by examiner

*Primary Examiner*—Harold Joyce
(74) *Attorney, Agent, or Firm*—Collard & Roe, P.C.

(57) ABSTRACT

A slot-shaped outlet having first flow guide means extending in the interior space of a flow chamber. The flow guide means are extensions of the parallel arranged longitudinal side flanks that extend from the outside to the inside of the slot outlet. The flow guide means are first parallel with each other, and subsequently extend in a curved manner, diverging from each other, with their free longitudinal edges resting closely against the inner surface of the flow chamber. There are second flow guide means arranged parallel with each other between the longitudinal side flanks. The second flow guide means extend transversely in relation to the longitudinal direction.

2 Claims, 2 Drawing Sheets

SLOT OUTLET ARRANGEMENT FOR AIR SCREEN INSTALLATIONS

BACKGROUND OF THE INVENTION

1. Field of the Invention

The invention relates to an air outlet arrangement for air screen installations.

2. The Prior Art

Air screen (or air veil) installations are increasingly employed for screening room areas against penetrating external air or against the outflow of room air. In order to achieve energy saving yet efficient screening of the air, the screens (or veils) of air have to exit from the installation in a relatively highly focused and directed manner. This requirement is satisfied by slot outlets. However, slot outlets have the drawback that they generate a relatively strong noise as the air is flowing out. Avoiding outflow noise is deemed desirable especially for air screening installations in work or public areas.

German utility model DE 89 14 343 U1 proposes a sound absorber for the pressure side of air screening installations. This sound absorber comprises a housing with a chamber lined with a sound absorbing material, and air inlet and air outlet openings arranged at right angles in relation to each other. A sound-absorbing, profiled body is arranged within the zone where the flow of air is reversed. The profiled body is tapered in the direction of air flow and extends over the entire width of the chamber. It has a cross section substantially in the form of a streamlined body.

The high technical manufacturing expenditure and the high costs associated therewith for the sound-absorbing lining of the housing have adverse effects in conjunction with the sound absorber. Furthermore, the arrangement of the profiled body where the flow of air is reversed leads to turbulence that reduces the degree of efficiency of such an air screen installation.

SUMMARY OF THE INVENTION

It is therefore an object of the invention to reduce the emission of noise in an air screen installation without raising the manufacturing and/or installation expenditures, and without impairing the degree of efficiency of the installation.

This object is accomplished by a slot-shaped outlet arrangement having first flow guide means extending in the interior space of a flow chamber. The flow guide means are extensions of the parallel arranged longitudinal side flanks of the slot outlet, which extend from the outside to the inside. The flow guide means are first parallel with each other, and subsequently extend in a curved manner, diverging from each other, with their free longitudinal edges resting closely against the inner surface of the flow chamber. There are second flow guide means arranged parallel with each other between the longitudinal side flanks transversely in relation to the longitudinal direction.

The flow chamber is connected with the pressure side of a ventilator or other device having the same effect as a ventilator. This way, the driven flow of air is capable of exiting from the slot outlet via the flow chamber with distribution of the air flow over the entire width or height of the area to be screened. This generates an at least substantially axial flow of air in the flow chamber, which is then radially deflected at the slot outlet and forms the screen or veil of air after it exits from the flow chamber.

The design of the slot outlet as defined by the invention, with the transition from the inner surface of the flow chamber formed by the close abutment of the free longitudinal edges of the extended longitudinal side flanks of the slot outlet on the inner surface of the flow chamber, and the curved design of the extended longitudinal side flanks of the slot outlet up to their parallel arrangement at the outlet, prevents eddying of the air flow within the course of its reversal from the axial into the radial direction. This prevents the generation of air flow noise of air screens that are blown out from the slot with a speed of at least up to 20 $ms^{-1}$, or at least greatly reduces the generation of such air flow noise. The second flow guide means, which are arranged parallel with each other between the longitudinal side flanks transversely to the longitudinal direction, subdivide the slot outlet in a multitude of blow chambers. This produces a flow of the air screen that is aligned with the angle of the second flow means in relation to the axial flow in the blow chamber. The second flow means are preferably arranged at right angles with respect to the axis of the blow chamber. The blow chambers are designed with at least substantially equally long edges, and with an inward length of the slot outlet, which is where the extended longitudinal side flanks extend parallel in the direction of flow upstream of the second flow guide means, that corresponds at least with the width of the gap of the slot outlet.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
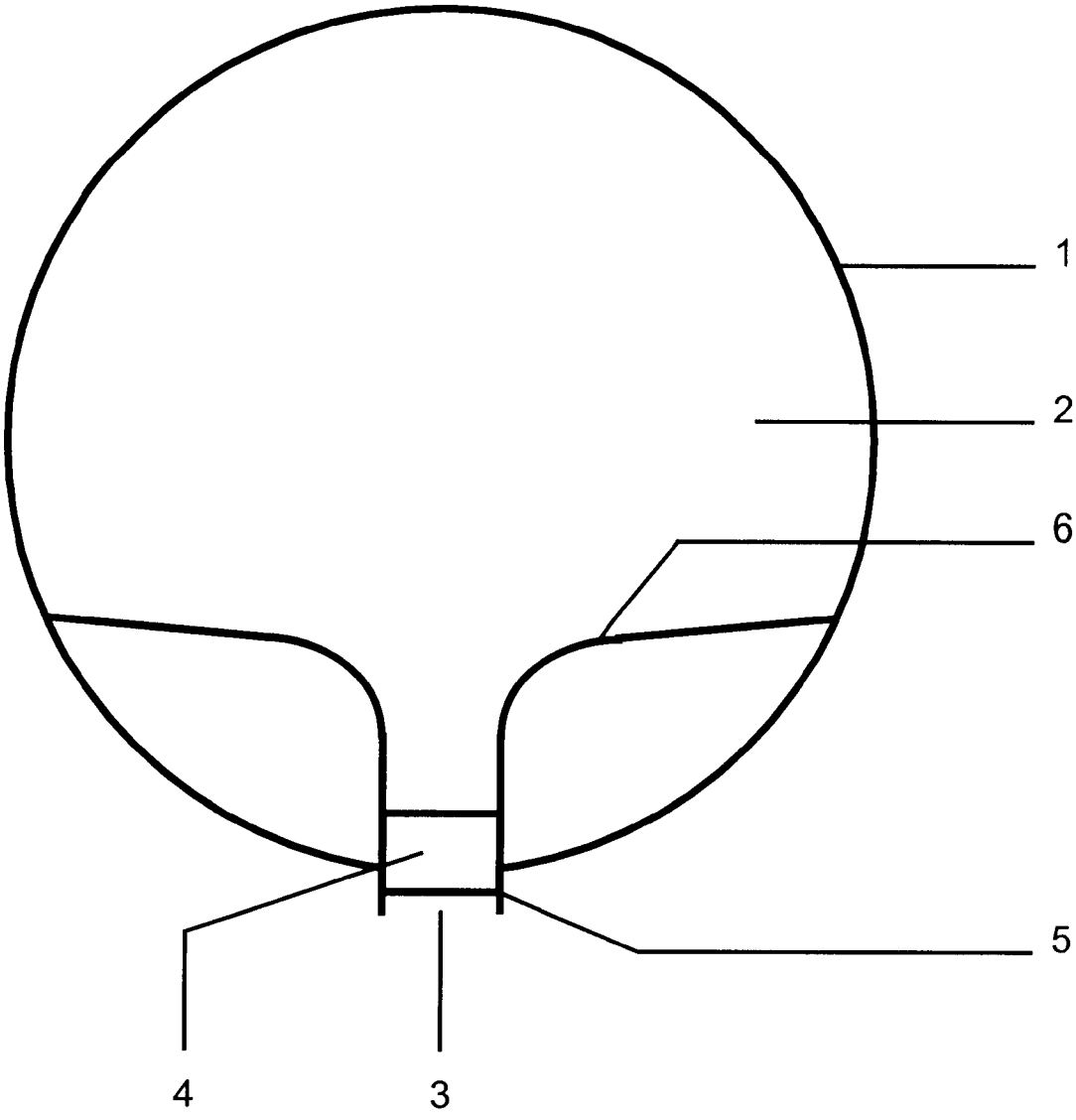
FIG. 1 shows a cross section through the flow chamber with the slot outlet.

Referring now in detail to the drawings, FIG. 1 shows a cross section through a cylindrical flow chamber 1. The interior space 2 is connected to a ventilator 7 (according to FIG. 2) on the pressure side. Flow chamber 1 has an axially parallel slot outlet 3, which is defined against the jacket of the flow chamber 1 by means of the parallel longitudinal side flanks 5. The longitudinal side flanks 5 are extended into the interior space 2 of flow chamber 1. Extensions 6 of the longitudinal side flanks 5 are curved and diverge from each other, so that their free longitudinal edges rest closely against the inner jacket surface of the flow chamber 1, and the slot outlet 3 forms an almost step-free drain for the flow prevailing in interior space 2 of flow chamber 1. Transverse lamellas 4, which serve as flow guide means, and which are arranged parallel with each other and equally spaced from each other between the longitudinal side flanks 5, divide slot outlet 3 in the blow chamber 41 (according to FIG. 2). Blow chamber 41 has a square cross section.

Slot outlet 3 can be produced by connecting the extended longitudinal side flanks 5 by transverse lamellas 4, which are in the form of a ladder-like plastic semi-finished product, and can then be inserted in a slot recess of the flow chamber 1, said slot recess being dimensioned accordingly. Because of their elasticity, the curved extensions 6 of longitudinal side flanks 5 cling closely to the inner jacket surface of flow chamber 1 at least at their free longitudinal edges.

Figure 2:
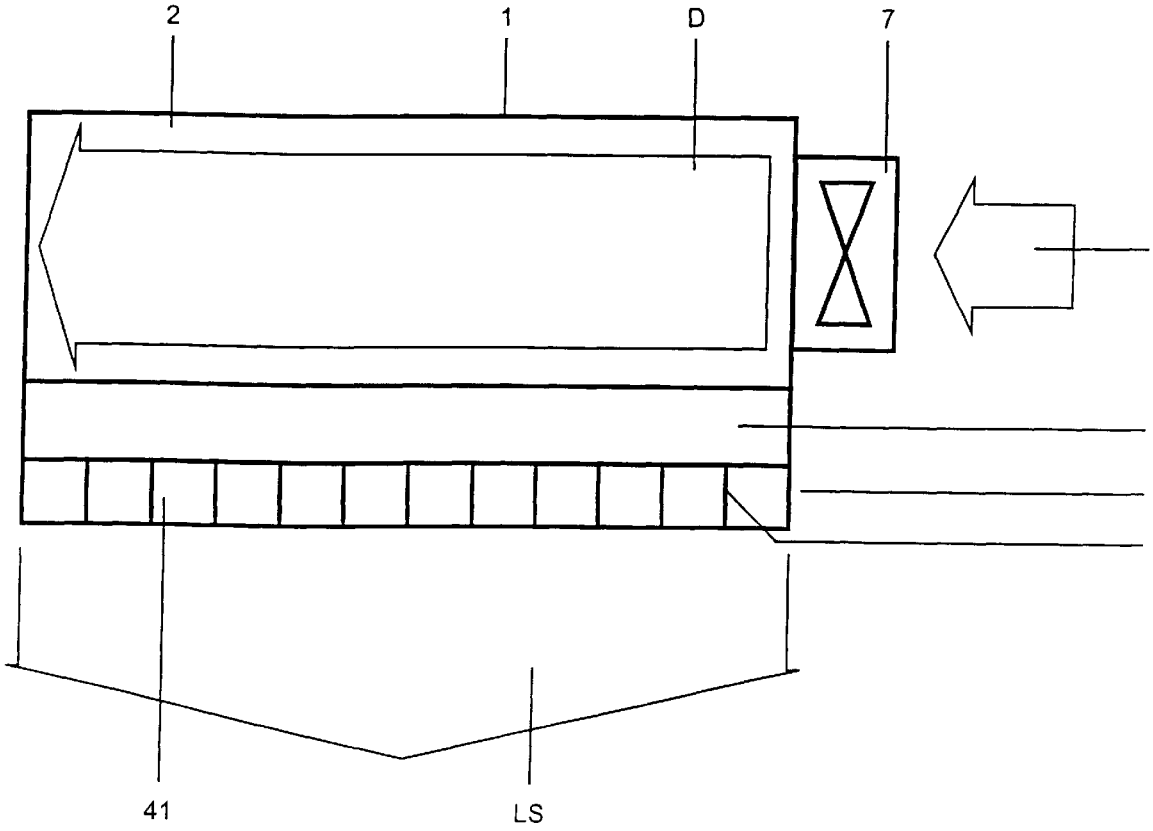
FIG. 2 shows a schematized longitudinal section through an air screening installation with a slot outlet.

FIG. 2 shows the basic mode of operation of the invention for forming an air screen "LS" with the help of a schematic longitudinal section through an air screen installation with a slot outlet 3 as defined by the invention. A ventilator 7 aspirates an air mass "S" and conveys it with formation of a pressure flow "D" into the interior space 2 of flow chamber 1. Pressure flow "D" substantially extends axially in the interior space 2 of flow chamber 1. Pressure flow "D", due to the pressure gradient between the inside and the outside, exits from the interior space 2 of flow chamber 1 by way of the axially parallel arranged slot outlet 3, and forms the air screen "LS". In this process, axial pressure flow "D" is deflected radially. The direction in which the air screen "LS" is blown out extends at a right angle in relation to the axis of flow chamber 1 and thus at a right angle in relation to the direction of pressure flow "D" because the transverse lamellas 4 arranged between the longitudinal side flanks 5, and said longitudinal side flanks 5 jointly form the blow chamber 41 guiding the flow. The depth and the clear spacing between transverse lamellas 4 correspond with the width of the gap of slot outlet 3. By virtue of the curvature of extensions 6 of longitudinal side flanks 5 of slot outlet 3, the direction of the flow of air can change with low generation of noise. The radius of the curvature is twice the width of the gap of slot outlet 3.

Accordingly, while only a few embodiments of the present invention have been shown and described, it is obvious that many changes and modifications may be made thereunto without departing from the spirit and scope of the invention.

What is claimed is:

1. A slot outlet arrangement for air screen installations with reversal of air flow, comprising:

a flow chamber with an interior space and a slot outlet;

a plurality of parallel longitudinal side flanks extending from the outside to said interior space;

first flow guide means extending in the interior space of said flow chamber, said flow guide means forming an extension of the side flanks and extending first parallel with each other, and subsequently in a curved manner diverging from each other, with their free longitudinal edges resting closely against an inner surface of the flow chamber; and second flow guide means arranged parallel with each other between the longitudinal side flanks, said second flow guide means being arranged transversely in relation to a longitudinal direction, wherein the depth of the second flow guide means and the spacing of said second flow guide means from each other are at least approximately equal to the width of a gap of the slot outlet.

2. The slot outlet arrangement according to claim 1, wherein a radius of curvature of the first guide means is at least approximately twice as large as the width of the gap of the slot outlet.

* * * * *